US006574821B1

(12) United States Patent
Dal Maso et al.

(10) Patent No.: US 6,574,821 B1
(45) Date of Patent: Jun. 10, 2003

(54) OPTIMIZED SCRAPER FOR A CONDUIT

(75) Inventors: Fabrice Dal Maso, Rueil-Malmaison (FR); Bernard Dewimille, Corbeil Essonne (FR); Adrien Braccolino, Joigny (FR); Lucien Montabord, Sartrouville (FR); Frédéric Pelletier, Paron (FR)

(73) Assignees: Institut Francais du Petrole, Rueil-Malmaison cedex (FR); FMC Europe SA, Sens cedex (FR)

( * ) Notice: Subject to any disclaimer, the term of this patent is extended or adjusted under 35 U.S.C. 154(b) by 0 days.

(21) Appl. No.: 09/959,191

(22) PCT Filed: Apr. 19, 2000

(86) PCT No.: PCT/FR00/01032

§ 371 (c)(1),
(2), (4) Date: Oct. 19, 2001

(87) PCT Pub. No.: WO00/67926

PCT Pub. Date: Nov. 16, 2000

(30) Foreign Application Priority Data

May 6, 1999 (FR) ..... 99 05891

(51) Int. Cl.[7] ..... B08B 9/04
(52) U.S. Cl. ..... 15/104.061
(58) Field of Search ..... 15/104.061, 3.5

(56) References Cited

U.S. PATENT DOCUMENTS 3,619,844 A * 11/1971 Collins
4,506,401 A * 3/1985 Knapp
5,457,841 A * 10/1995 Minton
5,698,042 A * 12/1997 Sims et al.

FOREIGN PATENT DOCUMENTS

FR 2612091 * 3/1987

* cited by examiner

*Primary Examiner*—Randall E. Chin
(74) *Attorney, Agent, or Firm*—Antonelli, Terry, Stout & Kraus, LLP

(57) ABSTRACT

A two-directional scraping device (1;25) intended for a fluid carrying pipe includes at least one thin disk (6) made of polymer stiffened by reinforcing means (8) secured to the disk. The disk, including the reinforcement, is divided into petals by at least two radial slots (11) whose length is smaller than the radius of the disk, the radius of the disk being substantially greater than the inside diameter of said pipe.

19 Claims, 2 Drawing Sheets

OPTIMIZED SCRAPER FOR A CONDUIT

BACKGROUND OF THE INVENTION

The invention relates to a two-directional scraper intended for fluid carrying pipes. The invention is notably well-suited to withstand both chemical attack and abrasion. When the same pipe is used for successively delivering different fluids, it is well-known to use scraper plugs to separate the fluids while cleaning the walls of the pipe. These scrapers can also be displaced all along the pipe in order to remove, at regular intervals, the deposits that may have formed on the inner walls.

Document EP-376,796 describes a two-directional scraper whose elastomer wear rings do not have a sufficient chemical and abrasion resistance for certain applications.

In order to overcome this drawback, it is advantageous to combine mechanical reinforcing elements with sealing and scraping elements.

SUMMARY OF THE INVENTION

The present invention thus relates to a two-directional scraping device intended for a fluid delivery pipe. The device comprises at least one thin disk made of polymer stiffened by means of reinforcing elements, and the disk is divided into petals by at least two radial slots whose length is smaller than the radius of said disk, said radius being substantially greater than the inside diameter of said pipe.

A second thin disk can be superposed on the first one so that the slots of the two disks are arranged in staggered rows in relation to one another.

Two sealing and scraping assemblies consisting each of at least one thin disk can be connected by a shaft and two end parts so as to space said two assemblies out by about the length of said shaft.

The thickness of the assemblies can be smaller than the space contained between the shaft and the end parts so that said thin disks can bend in both directions.

The scraping and sealing assembly can also comprise at least one non-reinforced polymer disk.

The reinforcing means can be metallic.

In a variant, the reinforcing means can be made of a composite material.

The reinforcing means can consist of a radially slotted disk.

The reinforcing means can consist of a disk slotted like the polymer scraping and sealing disk.

The reinforcing means can be embedded in the polymer disk.

The reinforcing means can be pressed on the polymer disk.

The polymer can be a polyamide, polyethylene, fluorinated polymer type thermoplastic, for example PEUHMW, ETFE, FEP, PVDF, ECTFE, PFA, PTFE, PEEK, and mixtures thereof; a thermosetting material such as epoxy or polyurethane; an elastomer.

The polymer can be filled with an abrasion-resistant material. 5

The invention also relates to the application of the device for scraping and/or separation of two fluids in a pipe delivering fluids chemically aggressive towards elastomers.

The invention is thus based on a concept using different means to fulfill two main functions:

polymer elements fulfilling scraping, sealing and abrasion resistance functions on contact with the pipe, reinforcing means, for example made of spring steel or composite, to provide sufficient stiffness for maintaining in contact with the wall of the tube, in particular at bends and during changes in the scraping direction.

BRIEF DESCRIPTION OF THE DRAWINGS

Other features and advantages of the present invention will be clear from reading the description hereafter of non-limitative examples, with reference to the accompanying drawings wherein.

DETAILED DESCRIPTION

Figure 1B:
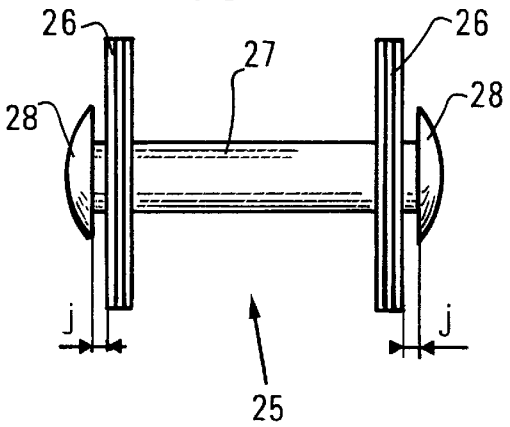
FIG. 1A diagrammatically shows, in cross-sectional view, an embodiment of a scraper according to the invention, FIG. 1B diagrammatically shows another embodiment.
Figure 1A:
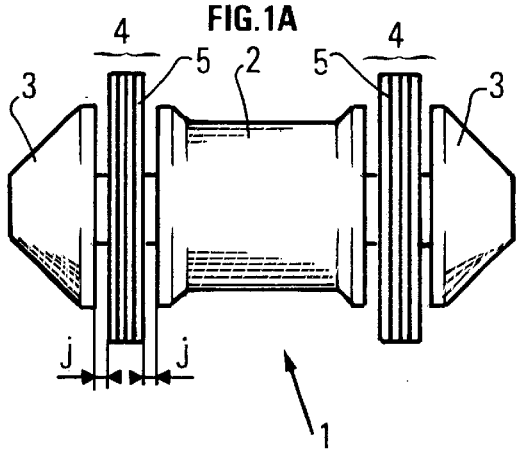

FIG. 1A describes a scraper 1 comprising a central body 2 contained between two end parts 3, generally identical insofar as the scraper is two-directional, but this configuration is not a limitation of the present invention. The main functions of these elements are fastening of the scraping elements and guidance of the scraper as it moves along the pipe and through bends. The shape of the end parts can be suited to allow to stop the scraper against any stopping device without damage. The assembly of these three parts is such that scraper disks 5 are piled up in each one of the two spaces 4. These disks are thin and their outside diameter is slightly greater than the inside diameter of the pipe to be scraped. The clearances j between the disks and body 2 or end parts 3 are generally necessary to allow bending and/or buckling strain of the disks when the scraper is fed into the pipe, and during changes in the scraping direction. The function of clearances j will appear more clearly in FIG. 3.

The number of superposed disks can be selected according to the desired scraping efficiency or to the longitudinal sealing level required. In some variants, some disks of the pile may not comprise reinforcing means and they can be made of a material favouring sealing between the disks without fulfilling any mechanical function. Such slotted sealing disks, such as the scraper disk, or non-slotted disks can be used.

FIG. 1B describes a scraper 25 mainly consisting of two piles 26 of scraper disks. A shaft 27 is used as a brace between the two piles and as a fastening means cooperating with two end parts 28 whose shape can allow to improve centering and guidance of the scraper in the pipe. This figure clearly shows the presence of clearances j allowing the required deformation of the disks on operation in the pipe.

Figure 2A:
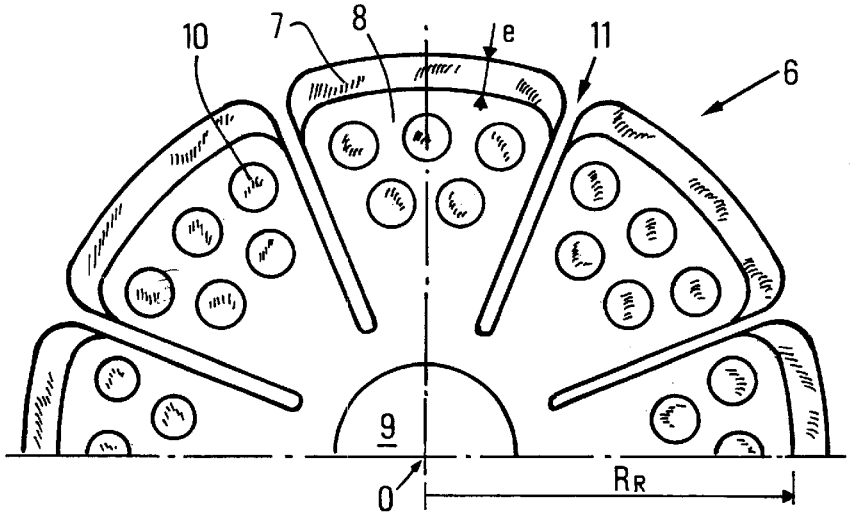
FIG. 2A shows, in front view, an example of a scraper disk.

The disks, more precisely described in FIG. 2A, are manufactured from a reinforcing core 8 sheathed with a plastic material. The diameter of the plastic sheath is such that the disk comprises an outer crown made of plastic alone, which forms the sealing and wear lip. The disks undergo compressive and bending stresses that are released on the inner surface of the tube in the form of contact and friction forces. These forces allow to provide sealing and scraping of the inner wall of the tube. FIG. 2A shows, in front view, a scraper disk comprising slots 11 in a radial direction so as to divide the disk into several petals 6. The reinforcing core is also slotted. On the outside of a petal, a part 7 of width e is made of polymer alone. The outside diameter of reinforcement 8 is thus smaller than the outside diameter of the scraper disk. A disk can therefore be worn through abrasion on the inner surface of the pipe without its sealing and scraping function being suppressed too rapidly. Reinforcement 8 comprises a central bore 9 for assembly onto the shaft or the body of the scraper. The reinforcing core can be metallic, made of spring steel, titanium or nickel alloy, or of a sufficiently stiff material so as to fulfill the function of stiffness reinforcement for the scraper disk, for example a composite material or equivalent. The radius Rr of the reinforcement is determined, considering the inside radius of the pipe, so as to reinforce the zone of the disk undergoing the greatest stresses when the disk placed in the pipe bends as it goes through a bend or during changes in the scraping direction. The outside diameter of the reinforcement is preferably smaller than the inside diameter of the pipe. A certain number of perforations 10 can allow to improve bonding of the plastic material on the reinforcing core. The reinforcing core can be sheathed with the plastic material or possibly pressed, for example by sticking, on the disk so as to secure the reinforcing core to the plastic disk.

It is clear that this slotted shape thus does not lead to a sealed structure, as it would be the case with a scraper cup according to the prior art. Radial slotting of the disk is however essential for each disk to allow the deformation required for proper operation in the pipe.

Figure 2B:
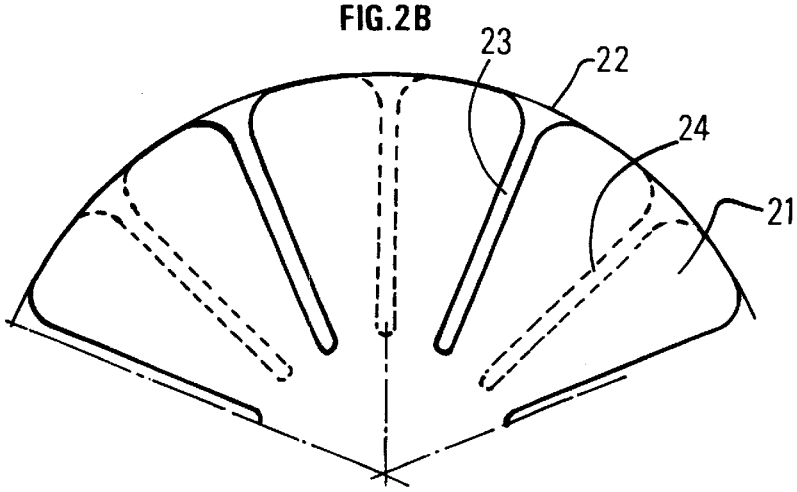
FIG. 2B shows the superposition of two scraper disks.
Figure 2C:
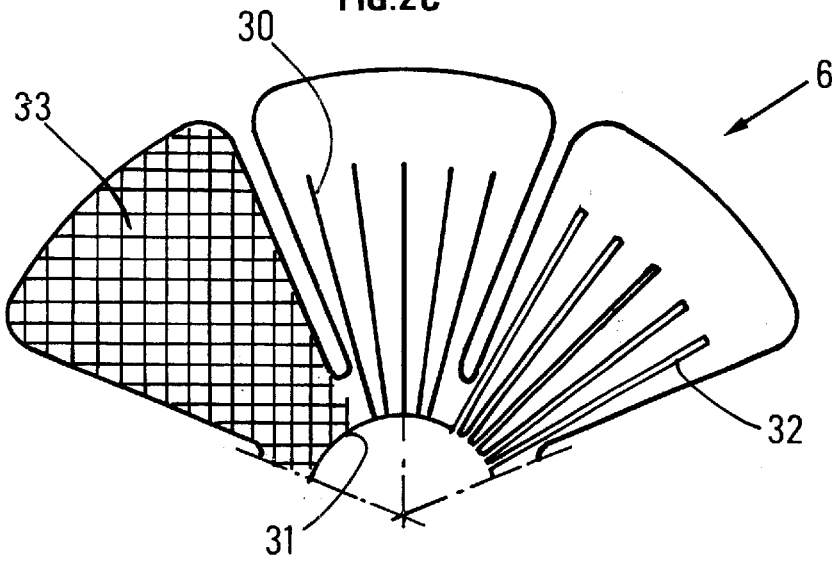
FIG. 2C shows several variants for the reinforcing means.

FIG. 2C describes other possible embodiments for the reinforcing means. Reference number 30 designates a reinforcement consisting of wires arranged radially and embedded in the plastic. The stiffness and the number of the wires determine the reinforcement level of disk 6. At the centre 31, the end of each wire can be supported by washers borne by the pin of the scraper. Reference number 32 shows a reinforcing core consisting of a series of radial plates. The stiffness of a metal or composite reinforcing disk can in fact be decreased by the presence of a certain number of radial slots. Reinforced petal 33 consists of polymer reinforced by a woven material, wire rope, glass fibers or equivalent. The reinforcing cloth has a determined surface area and thickness in order to obtain the desired stiffness of the petal. In order to obtain sealing of the scraper, at least two geometrically identical scraper and sealing disks are piled up so that slots 11 are arranged in staggered rows. FIG. 2B shows the superposition method for two disks 21 and 22 (dashed line). Slots 23 and 24 of each disk respectively must not coincide so as to substantially form a plastic washer by combination of the two disks. It is clear that one of the two disks may not comprise a reinforcement and can therefore be entirely made of polymer or any other suitable material, preferably also slotted in the form of petals, but this is not obligatory in the present invention. This disk mainly fulfils the sealing function only. This disk, made of polymer alone or of any other suitable material, is preferably arranged between two reinforced disks.

Example: Disks having the following geometry were subjected to sealing and alternate displacement tests in a pipe with an inside radius of 53.5 mm:

thickness of the sheathed disk: 2 mm, thickness of the spring steel reinforcement: 0.1 mm, radius of the spring: 40 to 45 mm, width e of the plastic crown: 9 to 18 mm.

The radius of the disk can range between 54 and 58 mm, preferably between 55 and 57 mm for a pipe having an inside radius of 53.5 mm.

The disk is cut out into eight petals of equal width.

Figure 3:
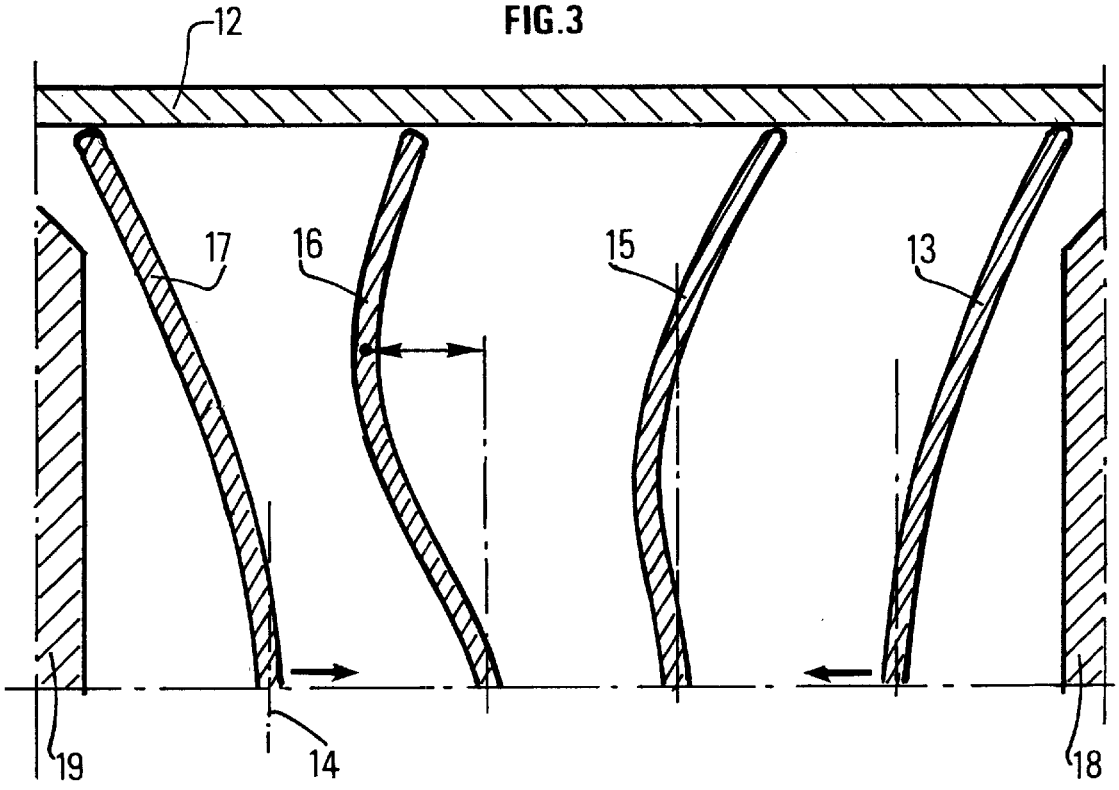
FIG. 3 shows, in partial cross-sectional view, the deformations of a scraper disk during a change of direction.

FIG. 3 describes the deformation of a disk in the case of a change in the scraping direction in inner pipe 12. The position of plate 13 shows the deformation of a disk when the scraper is fed into the pipe in the direction shown by reference number 14.

When the scraper is displaced in the opposite direction, each disk bends and buckles according to the deformations shown by sections 15 and 16, and eventually takes the final shape 17 symmetrical to shape 13. The silhouettes of dogs 18 and 19 show the usefulness and the role of clearances j in FIG. 1A. In particular, the distance d during buckling of the disk shows that a sufficient clearance, depending on the geometry of the disk and on the reinforcement thereof, is necessary for the disk to allow a change in the scraping direction.

It can be noted that the wear of the head of the plastic petals generates a decrease in the length of the plate and consequently a change in the contact forces against the wall. The wear of the head therefore directly conditions the lifetime of the scraper. It can thus be interesting to optimize this parameter by reducing the rate of wear of the material. The formulation of the base plastic can therefore be improved for example by filling it with abrasion-resistant particles or by mixing it with another polymer, PTFE for example. The plastic can also be filled with short carbon fibers for example. The modulus of the material then goes from E=655 MPa to E=6550 MPa. It has been observed that, in any case, the change of direction of the plate is not affected.

Examples of Materials Used

| | Young's modulus E (GPa) | Bending modulus $G = E/2\ (1 + \nu)$ (MPa) | Poisson's ratio $\nu$ | Elastic limit (MPa) | Elongation at break (%) |
|---|---|---|---|---|---|
| PFA | | 700 | 0.44 | 29 | 300 |
| ETFE | | 1700 | 0.42 | 28 | 150 |
| Steel | 200 | | | 1200–2000 | |
| Titanium | 100–120 | | | 350–800 | |
| Ni alloy | 180 | | | 200–350 | |

The present invention thus allows to obtain an optimized scraper as regards wear and resistance to aggressive fluids, but also as regards its implementation. In fact, for the same pipe, it is possible to superpose the number of disks required according to the situation: viscous fluid or not, provided with a filler or not, sealed separation, etc. Furthermore, reconditioning of a scraper could consist in changing only one disk and not the complete assembly of sealing and scraper disk piles.

What is claimed is:

1. Two-directional scraping device for a fluid delivery pipe, comprising at least one thin disk made of polymer stiffened by reinforcing means for reinforcing a zone of the at least one thin disk undergoing greatest stresses when the at least one thin disk goes through a bend in said pipe or during changes in scraping direction, said disk being divided into petals by at least two radial slots whose length is smaller than the radius of said disk, said radius being substantially greater than the inside diameter of said pipe.

2. A device as claimed in claim 1, further comprising a second thin disk is superposed on the at least one thin disk, said second disk being made of polymer stiffened by reinforcing means for reinforcing a zone of the second thin disk undergoing greatest stresses when the second thin disk goes through a bend in said pipe or during changes in scraping direction, said second thin disk being divided into petals by at least two radial slots whose length is smaller than the radius of said second disk, said radius being substantially greater than the inside diameter of said pipe, wherein the slots of the at least one and second disks are arranged in staggered rows in relation to one another.

3. A device as claimed in claim 1, wherein said scraping and sealing device further comprises at least one polymer disk that does not include reinforcing means.

4. A device as claimed in claim 1, wherein the reinforcing means are metallic.

5. A device as claimed in claim 4, wherein the reinforcing means comprise a radially slotted disk.

6. A device as claimed in claim 1, wherein the reinforcing means are made of a composite material.

7. A device as claimed in claim 1, wherein the reinforcing means are embedded in the polymer disk.

8. A device as claimed claim 1, wherein the reinforcing means are pressed against the polymer disk.

9. A device as claimed in claim 1, wherein said polymer is selected from the group consisting of a polyamide, polyethylene, fluorinated polymer type thermoplastic, a thermosetting material, and an elastomer.

10. A device as claimed in claim 9, wherein said polymer is filled with an abrasion-resistant material.

11. A device as claimed in claim 10, wherein said polymer is filled with an abrasion-resistant material.

12. A device as claimed in claim 10, wherein said radius of said reinforcing means is less than said inside diameter of said pipe.

13. A device as claimed in claim 1, wherein said polymer is a fluorinated polymer type thermoplastic selected from the group consisting of PEUHMW, ETFE, FEP, PVDF, ECTFE, PFA, PTFE and PEEK.

14. A device as claimed in claim 1, wherein said polymer is a thermosetting material selected from the group consisting of epoxy and polyurethane.

15. A device as claimed in claim 1, wherein a radius of said reinforcing means is less than said radius of said at least one thin disk so that an outer edge of said at least one thin disk is made only of said polymer.

16. A device as claimed in claim 15, wherein said radius of said reinforcing means is less than said inside diameter of said pipe.

17. A two-directional scraping device for a fluid delivery pipe comprising first and second sealing and scraping assemblies, each of said first and second scraping assemblies comprising at least one thin disk made of polymer stiffened by reinforcing means for reinforcing a zone of the at least one thin disk undergoing greatest stresses when the at least one thin disk goes through a bend in said pipe or during changes in scraping direction, said disk being divided into petals by at least two radial slots whose length is smaller than the radius of said disk, said radius being substantially greater than the inside diameter of said pipe, each of said first and second scraping assemblies being connected between a shaft and an end part so as to space said first and second scraping assemblies out by about the length of said shaft.

18. A device as claimed in claim 17, wherein the thickness of each of said first and second scraping assemblies is smaller than a space contained between the shaft and the end parts so that said thin disks can bend in both directions.

19. Application of the device as claimed in claim 1 for scraping and/or separation of two fluids in a pipe delivering fluids chemically aggressive towards elastomers.

* * * * *